United States Patent [19]

Wells

[11] 4,014,719

[45] Mar. 29, 1977

[54] FLEXIBLE EXPLOSIVE COMPOSITION COMPRISING PARTICULATE RDX, HMX OR PETN AND A NITROSTARCH BINDER PLASTICIZED WITH TEGDN OR TMETN

[75] Inventor: Franklin B. Wells, Memphis, Tenn.

[73] Assignee: The United States of America as represented by the Secretary of the Army, Washington, D.C.

[22] Filed: Oct. 23, 1975

[21] Appl. No.: 625,211

[52] U.S. Cl. ..... 149/19.7; 149/19.8; 149/92; 149/93; 149/108

[51] Int. Cl.[2] ..... C06B 45/10

[58] Field of Search ..... 149/19.8, 92, 93, 96, 149/108, 19.7

[56] References Cited

UNITED STATES PATENTS

| | | | |
|---|---|---|---|
| 3,018,201 | 1/1962 | Downard | 149/108 X |
| 3,048,507 | 8/1962 | Zebrec | 149/96 X |
| 3,300,348 | 1/1967 | Griffith | 149/93 |
| 3,317,361 | 5/1967 | Hopper et al. | 149/19.8 |
| 3,399,089 | 8/1968 | Griffith | 149/108 X |
| 3,400,025 | 9/1968 | Hopper et al. | 149/19.8 |
| 3,689,331 | 9/1972 | Pierce | 149/19.8 X |
| 3,723,207 | 3/1973 | Camp | 149/96 X |
| 3,878,003 | 4/1975 | LaPresti et al. | 149/19.8 |

*Primary Examiner*—Edward A. Miller
*Attorney, Agent, or Firm*—Nathan Edelberg; A. Victor Erkkila

[57] ABSTRACT

Flexible, self-supporting explosive compositions composed essentially entirely of a particulate high explosive RDX, HMX and/or PETN and a nitrostarch binder plasticized with trimethylolethane trinitrate and/or triethyleneglycol dinitrate.

7 Claims, No Drawings

FLEXIBLE EXPLOSIVE COMPOSITION COMPRISING PARTICULATE RDX, HMX OR PETN AND A NITROSTARCH BINDER PLASTICIZED WITH TEGDN OR TMETN

GOVERNMENTAL INTEREST

The invention described herein may be manufactured, used and licensed by or for the Government for Governmental purposes without the payment to me of any royalties thereon.

BACKGROUND OF THE INVENTION

Flexible, self-supporting explosive compositions comprising a high explosive, such as RDX (cyclotrimethylenetrinitramine), HMX (cyclotetramethylenetetranitramine), and/or PETN (pentaerythritol tetranitrate), and a plasticized nitrocellulose binder system have been found considerable application in the art. TMETN (trimethylolethane trinitrate) because of its relatively low sensitivity, high explosive power and lack of headache producing properties, is a particularly desirable energetic plasticizer for use in preparing such explosive compositions containing essentially 100% explosively active ingredients. However, its lack of ready colloiding power for nitrocellulose, as noted in U.S. Pat. No. 3,400,025 and my copending U.S. application Ser. No. 454,900, filed Mar. 26, 1974, and now U.S. Pat. No. 3,943,017, has largely discouraged its use as a plasticizer for nitrocellulose. TEGDN (triethyleneglycol dinitrate), which colloids nitrocellulose relatively readily, is also a desirable energetic plasticizer for use in such explosive compositions.

SUMMARY OF THE INVENTION

An object of the present invention is to provide a flexible explosive composition of very high power (at least 130% of the explosive power of TNT) and brisance (rate of detonation at least 8000 meters per second) based on a finely divided explosive such as cyclotetramethylenetetranitramine (HMX), cyclotrimethylenetrinitramine (RDX), pentaerythritol tetranitrate (PETN) or mixtures thereof bonded with TMETN- or TEGDN-plasticized nitrostarch.

Another object of the invention is to provide an explosive composition which, in the form of sheets of at least one-quarter inch thickness, possesses sufficient flexibility so that it may be made to conform to the contours of uneven surfaces with a minimum of manipulation, thus aiding in the ease of destruction of the object or device to be demolished.

Another object is to provide flexible sheet explosives which have good cap sensitivity while being sufficiently insensitive to impact and friction as to present no undue hazard to field personnel carrying this material under fire.

A further object of this invention is provision of a flexible explosive cmposition which is not adversely affected by water.

A still further object is the provision of a flexible explosive composition which retains flexibility at temperatures of −40° F. or lower.

Other and further objects of this invention will become apparent as the invention is further described hereinafter.

In accordance with the present invention, the foregoing objects are accomplished by novel explosive compositions, which are composed essentially entirely of explosive ingredients and consist essentially of 60–80% by weight of a finely divided high explosive selected from the group consisting of RDX, HMX and PETN and mixtures thereof and 20–40% by weight of a binder system consisting essentially of nitrostarch and a plasticizer therefor selected from the group consisting of TMETN and TEGDN and mixtures thereof, wherein the weight ratio of the nitrostarch to the plasticizer is about from 0.7/1 to 1.4/1, respectively. Small amounts up to 2–5% of conventional additives, such as stabilizers, pigments, etc. may also be present in the novel explosive compositions.

In view of its lack of ability to colloid nitrocellulose easily, as noted above, it was not obvious that TMETN could readily colloid nitrostarch without the use of a solvent, such as acetone and ethyl acetate, although solvents have been also employed in many cases in the present invention to assure of rapid preparational procedures. Further, it was not obvious that nitrostarch could be employed in place of nitrocellulose according to the present invention in view of the fact that low viscosity nitrocellulose cannot be substituted for high viscosity nitrocellulose in binder systems for flexible explosive compositions containing RDX, HMX and/or PETN, as disclosed in the aforementioned references.

When the high explosive content of the novel explosive compositions is between 60 and 74 weight percent, the aforesaid plasticized nitrostatch binder system content is between 26 and 40 weight percent, and the nitrostarch/plasticizer weight ratio is about from 0.7/1 to 1.2/1, the compositions generally can be rolled into sheets of good flexibility, and are therefore preferred. When the proportions and ratios of these ingredients are outside these preferred parameters, but are within the aforesaid broad parameters for the novel explosive compositions, the compositions generally are not sufficiently plastic to permit rolling into sheets suitable for use as a flexible sheet explosive; however, they can be compression molded and machined and still possess sufficient flexibility or resilience so that the charges can be press loaded to conform to slight contour irregularities of the item casing. When the proportion of the particulate high explosive exceeds about 80%, the composition produced is generally too stiff for compression molding to produce flexible compositions; and when the proportion thereof is less than about 60%, the composition is too soft and sticky. Further, when the weight ratio of nitrostarch to plasticizer is less than about 0.70, the strength of the binder system is generally insufficient for use in the present compositions; while when the weight ratio thereof is greater than about 1.4, the composition tends to harden on storage until at a ratio of about 1.5 or higher, it generally loses flexibility within a few days.

The high explosives employed in the compositions of the present invention possess an average particle size not exceeding about 25 microns, although both larger and smaller particles thereof may be present. Preferably 100% of the particulate explosive must pass through a No. 200 USS sieve and at least 90%, and preferably not less than 95%, should pass through a No. 325 USS sieve. Use of any appreciable amounts of coarser grades of particulate explosive tends to result in increased flexibility, loss of elasticity and a product in which the grains of particulate explosive are readily visible by reflected light.

Commercial nitrostarches, as ordinarily produced by nitration of starch, contain from about 12.6% to about 13.3% nitrogen, and are suitable for use in the present invention. For optimum results, the nitrostarch employed in the explosive compositions of the present invention possesses a nitrogen content within the range of about from 12.9% to 13.1%.

The following examples provide further specific illustrations of the explosive compositions of this invention. In the examples the percentages reported are by weight.

Compositions 1–13 shown in example I–IV were prepared in 50 gram batches by mixing together the dry particulate high explosive, nitrostarch and DPA (diphenylamine) stabilizer, stirring in the plasticizer and solvent, if used, allowing the mixture to stand covered for periods of about 4 to 24 hours, rolling on a roll mill with a 0.002 inch gap setting held at 135°–140° F until all odor of solvent had disappeared. Where no solvent was employed, the composition was rolled for 5 minutes, about the average time taken in rolling when solvent was used, so that there would be no appreciable processing differences between the various compositions. In each case, the thin sheets thus obtained were later consolidated on the roll mill using a gap setting of 0.230 inch and at the indicated temperature. As reported in the examples, the DPA was present as an added percentage above 100%.

EXAMPLE I

| Composition No. | 1 | 2 | 3 |
|---|---|---|---|
| HMX, Type II, Class B[1] | 80.00% | 76.00% | 75.00% |
| Nitrostarch[2] | 10.00% | 14.00% | 12.00% |
| DPA | 0.50% | 0.76% | 0.60% |
| TMETN | 10.00% | 10.00% | 13.00% |
| Ethyl acetate | 30 ml. | 30 ml. | 30 ml. |

[1]All HMX used in the preparation of compositions of this invention is Type II and of the class specified and is in accordance with the requirements of specification MIL-H-45444A (Ord) wit Amendment 3 dated July 31, 1952.

[2]Nitrogen Content 13.08%. This nitrostarch was used in Compositions 1 through 14.

These were all rolled into approximately ¼ inch thick sheets at a roll temperature of 65° C. After cooling to room temperature, the sheets possessed the following properties:

| | | |
|---|---|---|
| Composition | 1 | was too dry and crumbly to roll into a sheet. |
| Composition | 2 | formed a very poor uneven sheet which had poor cohesion and broke up readily into crumbly particles. |
| Composition | 3 | gave a sheet that was too stiff for use as a flexible sheet explosive. |

All three compositions, when comminuted, can be compression-molded to produce a charge, the surface of which yields under pressure of the fingers and returns to its original position on release of such pressure.

EXAMPLE II

| Composition No. | 4 | 5 |
|---|---|---|
| HMX | 73.00% | 70.00% |
| Nitrostarch | 14.00% | 14.00% |
| DPA | 0.70% | 0.70% |
| TMETN | 13.00% | 16.00% |
| Ethyl Acetate | 30 ml. | 30 ml. |

These were rolled in the same manner as were Compositions 1–3 with the following results:

| | | |
|---|---|---|
| Composition | 4 | formed a smooth tough sheet which was somewhat tacky |
| Composition | 5 | formed a smooth sticky sheet, less stiff than Composition 4. |

The sheets thus obtained lost most of their tackiness on storage for a couple of days to become good flexible sheets with that of Composition No. 5 being somewhat more flexible and elastic than that of Composition No. 4.

EXAMPLE III

| Composition | 6 | 7 | 8 | 9 | 10 |
|---|---|---|---|---|---|
| HMX | 76.00% | 76.00% | 74.00% | 74.00% | 72.00% |
| Nitrostarch | 14.00% | 12.00% | 12.00% | 14.00% | 14.00% |
| DPA | — | 0.60% | 0.60% | 0.70% | 0.70% |
| TEGDN | 10.00% | 12.00% | 14.00% | 12.00% | 12.00% |
| Ethyl Acetate | 30 ml. | — | — | — | — |

| | | |
|---|---|---|
| Composition | 6 | was rolled in the same way as were composition Nos. 1–3 to give a very poor dry sheet crumbled easily. |
| Composition | 7 | 7 was rolled in the same way to produce a good smooth Flexible rubbery sheet. |
| Composition | 8 | was so sticky when rolled in the same way as above that it could not be removed as a sheet from the roll, but when rolled at 20° C. it gave a soft, sticky, rather weak sheet. |
| Composition | 9 | rolled at 20° C. gave a good smooth flexible sheet. |
| Composition | 10 | rolled at 20° C. gave a very flexible, tacky, rubbery sheet which lost most of its tackiness overnight. It was found to have a Cold Test Value of −45° F.[3] |

[3]The Cold Temperature Test is described in paragraph 4.3.12 of specification MIL-E-46676A(MU), 7 April 1964. For this invention the test was run at various temperatures 10 Farenheit degrees apart and the ¼ inch mandrel over which the samples were bent 90° in 5 seconds was at the same temperature as the samples tested. When temperatures 10° apart at which the samples passed and failed were found, another test at a temperature midway between was run. The test result is reported as that temperature at which the samples pass the test which is 50° F. above the highest temperature at which failure occurred.

EXAMPLE IV

| Composition No. | 11 | 12 | 13 |
|---|---|---|---|
| HMX | — | — | 35.00% |
| RDX, Type B, Class E[4] | 70.00% | — | — |

EXAMPLE IV-continued

| Composition No. | 11 | 12 | 13 |
|---|---|---|---|
| PETN[5] | — | 70.00% | 35.00% |
| Nitrostarch | 14.00% | 14.00% | 14.00% |
| TMETN | 16.00% | 16.00% | 16.00% |
| Ethyl acetate | 30 ml. | 30 ml. | 30 ml. |

[4]All RDX used in the preparation of the compositions of this invention is Type B and of the class specified and is in accordance with the requirements of Specification MIL-R-398C dated Aug 22, 1962

[5]Uniform 10-12 micron material

These were all prepared and rolled in the same way as were Compositions 1–3 and gave the following results:

| | | |
|---|---|---|
| Composition | 11 | formed a good smooth tough sheet |
| Composition | 12 | gave a sheet like that of Composition No. 11, but a little stiffer |
| Composition | 13 | gave a sheet like that of Composition No. 12 |

EXAMPLE V

| Composition No. | 14 | 15 |
|---|---|---|
| HMX | 350.0 g. (70%) | 340.0 g. (68%) |
| Nitrostarch | 70.0 g. (14%) | 70.0 g. (14%)[6] |
| DPA | 3.5 g. (0.7%) | 3.5 g. (0.7%) |
| TMETN | 80.0 g. (16%) | 90.0 g. (18%) |
| Ethyl acetate | 75 ml. | 75 ml. |

[6]13.07% nitrogen content nitrostarch used in this composition

In both compositions the initial mixing of dry HMX, nitrostarch and DPA was done by hand, this mixture was transferred to a small sigma blade mixer, the TMETN and ethyl acetate added and the mixer run about 3 minutes with the top closed, stirring stopped, material cut down from the walls, the mixer run two minutes longer with the top off, and the mixtures rolled into thin sheets as described earlier. In each case, the thin sheets were then consolidated on the roll mill at a gap setting of 0.240 inch and a roll temperature of 75° C, Reasonable smooth tough elastic sheets were obtained from both compositions. These materials were tested with the following results:

| Composition No. | 14 | 15 |
|---|---|---|
| Vacuum Stability Test (ml. gas)[7] | 2.71 | — |
| P.A. Impact Sensitivity (2 kg. hammer)[8] | 13 inches | 15 inches |
| Electrostatic Sensitivity Test[9] (joule) | 4.044 | 4.044 |
| Friction Sensitivity[10] (steel shoe) | no action | — |
| Cold Temperature Test[11] | — | 10° C |

[7]This test result, as ml. gas evolved by a 5 g. sample held 40 hrs. at 100° C. is described in PATR (Picatinny Arsenal Technical Report) 3278, Rev. 1 by A.J. Clear dated April 1970

[8]The Picatinny Arsenal Impact Sensitivity Test is described in PATR 3278, Rev. 1, dated April 1970

[9]The test is described in PATR 3278, rev. 1, dated April 1970

[10]Described in P.A. Testing Manual 7-1 dated May 8, 1950

[11]Performed as for Composition 10 except 10° C. temperature intervals were used

EXAMPLE VI

| Composition No. | 16 |
|---|---|
| HMX | 7718 grams (68.0%) |
| Nitrostarch[12] | 1589 grams (14.0%) |
| DPA | 79.5 grams (0.7%) |
| TMETN | 2043 grams (18.0%) |
| Ethyl Acetate | 1000 ml. |

[12]In this and Composition No. 17 the nitrogen content of the nitrostarch was 12.92%

This composition, identical compositionwise with Composition No. 15, was prepared by placing the ethanol-moist HMX and nitrostarch in a five gallon sigma blade mixer and stirring these together about two minutes. The material was cut down off the sides of the mixer and the TMETN and DPA, dissolved in the ethyl acetate added and the whole mixed 30 minutes in three 10-minute periods at the end of each of which the material was cut down off the walls. After standing overnight, the batch was formed into sheets by rolling on a large mill in a manner identical with that used with Composition No. 15. This material was characterized by several tests as follows:

| | |
|---|---|
| Vacuum stability test (ml. gas) | 2.98 |
| Density (g./cc.) | 1.592 |
| % Theoretical Maximum Density(of 1.751 g./cc.) | 90.92% |
| Detonation velocity (m./sec.)[13] | 8219 |
| Cap Sensitivity test[14] | No. 8 Cap |
| Friction pendulum (steel shoe) | No crackles, fire, or explosion |
| Bullet impact test[15] | No fire or explosion |
| Ballistic pendulum test (TNT = 1)[16] | 1.316 |
| Water Immersion[17] | No change |

-continued

| | |
|---|---|
| Plate damage test[18] | Excellent steel cutting power |

[13]Specimens used were ¼ inch × 1 inch × 15 inches long, unconfined
[14]¼ × ¾ inch slot is cut into one end of a ¼ × 1 × 12 inch strip, a standard cap crimped onto miners' fuze inserted and taped into this slot and the cap fired. The result is given as the smallest (lowest no.) cap causing complete detonation of test specimens in each of five consecutive tests.
[15]Specification MIL-E-46676A (MU), paragraph 4.3.7.
[16]This test is described by J. H. McIver in P.A. Testing Manual 7-2 dated May 8, 1950
[17]Test described in paragraph 4,4,4,1 of Specification MIL-E-46676 (MU), "Explosive, Flexible" with Amendment 1, dated 20 April 1963. After being held 24 hours in water at 160° F., samples, within 2 minutes after removal from the hot water, could be bent 90° around a ¼ inch mandrel in 5 seconds without breaking and without development of a crack more than 1/16 inch deep on the face away from the mandrel.
[18]This test is carried out by centering a 3 inch × 10 inch sheet of explosive on a ¼ inch and 4 inch × 12 inch mild steel witness plate set on a smooth, compact damp sand surface. The sheet is fired with an M6 cap set into a ¼ inch wide × ¾ inch deep slot cut into the center of one end thereof. In the case of 0.080 inch thick sheets, a small piece of this thin sheet material is laid across the top of the initiating cap so that both ends thereof are in contact with the sheet. In this test all sheets fired completely and examination of the steel witness plates recovered after firing sheets 0.08 inch, 0.16 inch and 0.25 inch thick showed this material to be a more effective steel-cutting agent than any other known sheet explosive. It was shown to be about 100% more effective than the duPont EL 506C described in PATR 4612 or the P.A. developed replacement therefor described in U.S. 3,317,361, U.S. 3,354,010, and PATR 4714, and up to about 50% more effective than the P.A. developed sheet explosive described in U.S. 3,400,025 and PATR 4713 wherein a major portion of the plasticizer is energetic.

Composition 16 was also pressed into 2.5 inch diameter pellets as follows:

| Pellet No. | 1 | 2 |
|---|---|---|
| Pressing temperature (° F.) | 135° | 140° |
| Pellet weight (grams) | 265.6 | 240.0 |
| Pellet density (grams/cc.) | 1.776 | 1.777 |
| TMD* (grams/cc.) | 1.761 | 1.761 |
| Pellet density as % TMD* | 100.85 | 100.85 |

*The pellet density of over 100% of the theoretical maximum density (TMD) is believed to be due, in part at least, to solution of the nitrostarch in the plasticizer.

In preliminary work leading to the compositions of the present invention, it was noted that mixtures of nitrostarch and TMETN were essentially clear while corresponding mixtures of nitrocellulose and TMETN wherein colloidation was complete, even when very minor amounts of nitrocellulose were present, exhibited varying degrees of haziness by comparison. It was unexpectedly discovered that nitrostarch/TMETN bonded explosive compositions of the present invention could be compressed to products having densities greater than the calculated theoretical maximum density. In view of the foregoing, it is believed, although not as yet proved, that the nitrostarch at least in part forms a true solution in the plasticizers employed so that conventional TMD calculations of the resulting compositions result in values below those representing the true situation as is normal for solutions.

The foregoing disclosure is merely illustrative of the principles of this invention and is not to be interpreted in a limiting sense. I wish it to be understood that I do not desire to be limited to the exact details of construction shown and described, because obvious modifications will occur to a person skilled in the art.

I claim:

1. A flexible, self-supporting explosive composition of high power and brisance composed essentially entirely of explosive ingredients and consisting essentially of:

a. from 60 to 80 weight percent of a particulate high explosive selected from the group consisting of cyclotrimethylenetrinitramine, cyclotetramethylenetetranitramine and pentaerythritol tetranitrate and mixtures thereof having an average particle size not exceeding about 25 microns; and b. from 20 to 40 weight percent of a binder system consisting essentially of nitrostarch of from 12.6 to 13.3 percent nitrogen content and a plasticizer therefor selected from the group consisting of trimethylolethane trinitrate and triethyleneglycol dinitrate and mixtures thereof, wherein the weight ratio of the nitrostarch to the plasticizer is about from 0.7/1 to 1.4/1, respectively.

2. The composition of claim 1, wherein the nitrostarch has a nitrogen content of from 12.9 to 13.1 percent.

3. A flexible, self-supporting explosive composition of high power and brisance adapted for use as a flexible sheet explosive, composed essentially entirely of explosive ingredients and consisting essentially of:

a. from 60 to 74 weight percent of a particulate high explosive selected from the group consisting of cyclotrimethylenetrinitramine, cyclotetramethylenetetranitramine and pentaerythritol tetranitrate and mixtures thereof having an average particle size not exceeding about 25 microns; and b. from 26 to 40 weight percent of a binder system consisting essentially of nitrostarch of from 12.6 to 13.3 percent nitrogen content and a plasticizer therefor selected from the group consisting of trimethylolethane trinitrate and triethyleneglycol dinitrate and mixtures thereof, wherein the weight ratio of the nitrostarch to the plasticizer is about from 0.7/1 to 1.2/1, respectively.

4. The composition of claim 3, wherein the nitrostarch has a nitrogen content of from 12.9 to 13.1 percent.

5. The composition of claim 3, wherein the plasticizer is trimethylolethane trinitrate.

6. The composition of claim 3, wherein the plasticizer is triethyleneglycol dinitrate.

7. The composition of claim 3, wherein at least 90% of the particulate explosive passes through a No. 325 U.S.S. sieve.

* * * * *